US005396956A

United States Patent [19]

Cherewyk et al.

[11] Patent Number: 5,396,956

[45] Date of Patent: Mar. 14, 1995

[54] WELL HEAD ISOLATION TOOL SEALING NIPPLE TESTING APPARATUS AND METHOD OF PRESSURE TESTING ISOLATION TOOL SEALING NIPPLE SEALS WHEN IN POSITION ON A WELL

[76] Inventors: Bruce Cherewyk, 10105 - 82 Avenue, Grande Prairie, Alberta; Roderick D. McLeod, 5104 - 125 Street, Edmonton, Alberta; Albert Roesch, 28 Parson's Close, Red Deer, Alberta, all of Canada

[21] Appl. No.: 165,495

[22] Filed: Dec. 13, 1993

[30] Foreign Application Priority Data

Dec. 18, 1992 [CA] Canada ..... 2085780

[51] Int. Cl.[6] ..... E21B 19/00; E21B 23/00; E21B 33/03; E21B 33/04

[52] U.S. Cl. ..... 166/250; 166/88; 166/191; 166/380; 166/387; 166/337

[58] Field of Search ..... 166/77, 86, 88, 80, 166/73, 186, 191, 250, 336, 337, 380, 387; 285/110

[56] References Cited

U.S. PATENT DOCUMENTS

| | | | |
|---|---|---|---|
| 2,621,743 | 12/1952 | Johnston | 166/186 X |
| 2,726,723 | 12/1955 | Wilhoit et al. | 166/186 X |
| 4,241,786 | 12/1980 | Bullen | 166/77 |
| 4,601,494 | 7/1986 | McLeod | 285/110 |
| 4,632,183 | 12/1986 | McLeod | 166/77 |
| 4,691,770 | 9/1987 | McLeod | 166/73 |
| 4,867,243 | 9/1989 | Garner | 166/77 X |
| 4,993,488 | 2/1991 | McLeod | 166/72 |
| 4,993,489 | 2/1991 | McLeod | 166/72 |
| 5,103,900 | 4/1992 | McLeod | 166/88 |

FOREIGN PATENT DOCUMENTS

| | | |
|---|---|---|
| 1094945 | 2/1981 | Canada . |
| 1169766 | 6/1984 | Canada . |
| 1222204 | 5/1987 | Canada . |
| 1267078 | 3/1990 | Canada . |
| 1272684 | 8/1990 | Canada . |

*Primary Examiner*—Stephen J. Novosad
*Attorney, Agent, or Firm*—Anthony R. Lambert

[57] ABSTRACT

A wellhead isolation tool nipple seal testing apparatus includes an upper seal, upper nipple, and a lower seal and a lower nipple, the lower nipple being attached to the upper nipple. Test pressure forced between the upper and lower seals may be used to test the upper nipple up to well servicing pressures. The lower nipple may seal the well bore by being closed, or by the use of a mandrel carrying a seal on its lower end or with a burst disk.

12 Claims, 7 Drawing Sheets

WELL HEAD ISOLATION TOOL SEALING NIPPLE TESTING APPARATUS AND METHOD OF PRESSURE TESTING ISOLATION TOOL SEALING NIPPLE SEALS WHEN IN POSITION ON A WELL

FIELD OF THE INVENTION

This invention relates to wellhead isolation tools and a method and apparatus for pressure testing the isolation tool nipple seals in the casing or tubing when the isolation tools are in position on a wellhead.

BACKGROUND OF THE INVENTION

In the oilfield service industry and specifically in the division known as the wellhead isolation tool service industry, there are several wellhead isolation tools as for example described in: Bullen, A Well Tree Saver, Canadian Patent No. 1,094,945, U.S. Pat. No. 4,241,786, McLeod, an Insertion Drive for Tree Savers, Canadian Patent No. 1,222,204, U.S. Pat. No. 4,632,183, Dallas-Garner, Wellhead Isolation Tool and Setting Device and Method of Using Same, Canadian Patent No. 1,267,078, U.S. Pat. No. 4,867,243. The purpose of these tools is to insert a mandrel with a sealing nipple through a wellhead and into the well casing or tubing where the sealing nipple seals against the inside of the casing or tubing in order to allow high pressure fluid to be injected into the casing or tubing and bypass the wellhead configuration. For this discussion and throughout this patent document, we will refer only to the casing although the same testing apparatus and method will apply to the tubing. Two of the many nipple sealing means as mentioned in Bullen are: McLeod, a Nipple Insert, Canada Patent No. 1,169,766, U.S. Pat. No. 4,601,494, which features a bonded seal and Sutherland-Wenger, a Wellhead Isolation Tool Nipple, Canada Patent No. 1,272,684 which uses a removable seal. It is sometimes found that this sealing nipple on the end of the mandrel in contact with the casing may begin to leak between the casing and the sealing nipple seal under the high pressures encountered after the commencement of a well treatment. This leakage presents a dangerous situation and requires stopping the high pressure treatment of the well and replacing the sealing nipple with one of a tighter fit or a more durable seal material. The industry requires a method of testing the sealing capability of the sealing nipple in place in the well casing prior to beginning the well treatment. The pressure test must be made to a small percentage above the maximum pressure that will be encountered during the well treatment.

SUMMARY OF THE INVENTION

The invention comprises a mechanical arrangement of the sealing nipple assembly which will allow a regulated fluid pressure from a source outside the well to be introduced to the area where the seal of the sealing nipple is in contact with the inside surface of the casing. The apparatus is adaptable to all wellhead isolation tools known to the inventors. By including the testing apparatus with the nipple of the wellhead isolation tool itself, the testing apparatus is simultaneously installed on the wellhead when the isolation tool is installed on the wellhead. The testing operation is accomplished with the isolation tool mounted on the wellhead and the mandrel and sealing nipple in the operating position in the casing. The fluid pressure is selected by the customer and will test the seal to a pressure exceeding that expected as a maximum during the servicing procedure. Further summary of the invention will be found in the description and particularly as defined in the claims that follow.

BRIEF DESCRIPTION OF THE DRAWINGS

There will now be described a preferred embodiment of the invention, with reference to the drawings, by way of illustration, in which like numerals denote like elements and in which.

DETAILED DESCRIPTION OF PREFERRED EMBODIMENTS

Figures 1, 2, 3:
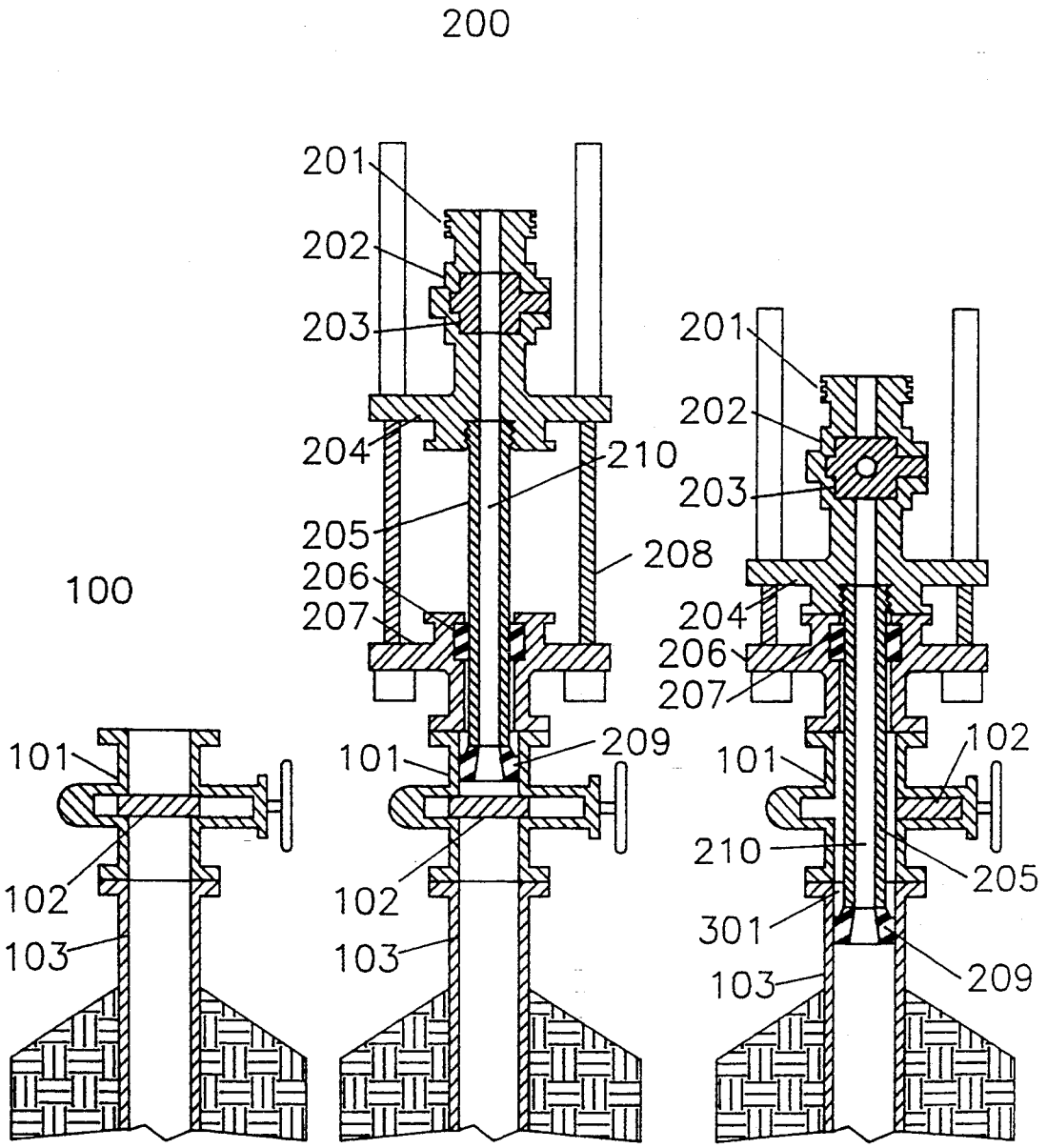
Figure 1 Prior Art
Figure 2 Prior Art
Figure 3 Prior Art
FIG. 1 is a prior art single valve wellhead in side view cross section with the valve gate closed.
FIG. 2 is a prior art isolation tool in side view cross section mounted on the single valve wellhead of FIG. 1.
FIG. 3 is the isolation tool of FIG. 2 in side view cross section with the mandrel extended through the opened valve of the single valve wellhead of FIG. 1 and into sealing position in the casing.
Figure 5:
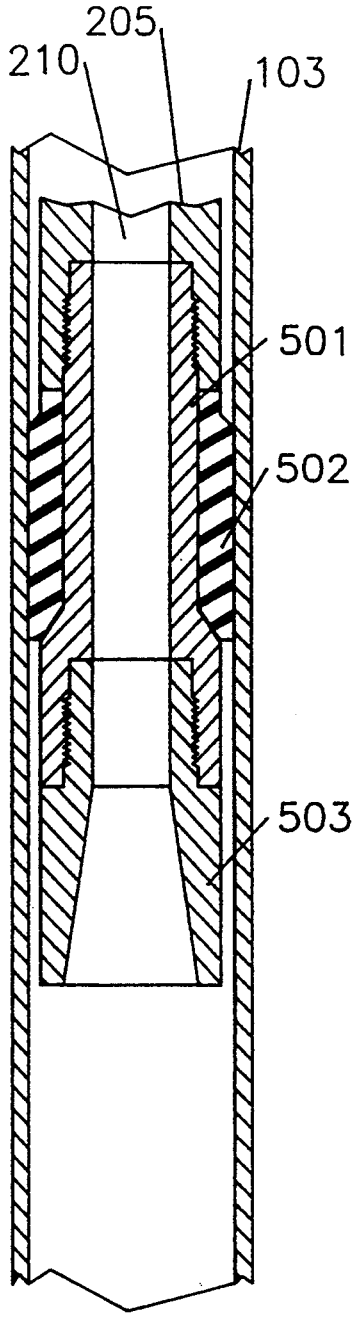
Figure 5 Prior Art
FIG. 5 is a side view cross section of a prior art single seal sealing nipple with a removable seal.

Referring to FIG. 1 and all following Figures, all of the items noted are circular in cross section with a central axis as shown in FIG. 5. Throughout this patent disclosure and in particular in the claims, downward means the direction down the well as if the sealing nipple were installed at a well, and in each Figure means towards the bottom edge of the drawing sheet. The terms upper and lower have like meaning, that is, a lower nipple will be further down the well than an upper nipple during operation. The components shown in the drawings are primarily made of steel, except for the seals which are made of elastomeric material, this being well known in the art.

The operation of the seal testing system requires that the installation procedure of a prior art isolation tool be described, which may be easily understood from the following description in conjunction with FIGS. 1, 2 and 3. FIG. 1 shows a simple wellhead generally at 100 with a wellhead valve 101, valve gate 102 shown in the closed position and well casing 103. The interior of the casing defines the well bore. FIG. 2 shows a simple isolation tool generally at 200 installed on the wellhead of FIG. 1. It features an upper connection 201, a valve at 202 with valve plug 203 shown in the open position, these items all being assembled to an upper beam 204. Mandrel 205 connects to the upper beam 204. A vertical bore 210 extends through the tool and the components just mentioned to sealing nipple 209 at the base of the mandrel 205. Lower beam 207, connected by power screws 208 to upper beam 204, houses packing 206. The power screws 208, when actuated, will bring the beams together and move the mandrel and sealing nipple down through the wellhead valve and into the well casing.

FIG. 3 shows the isolation tool in the final position on the wellhead with the valve plug in the closed position and the sealing nipple in the casing creating an annular space 301 which will not be subject to the high pressures that will be created by fluids being pumped through the isolation tool vertical bore and into the casing during well servicing. The wellhead valve gate is shown in the open position, which allows the mandrel and nipple to pass through.

Figure 4:
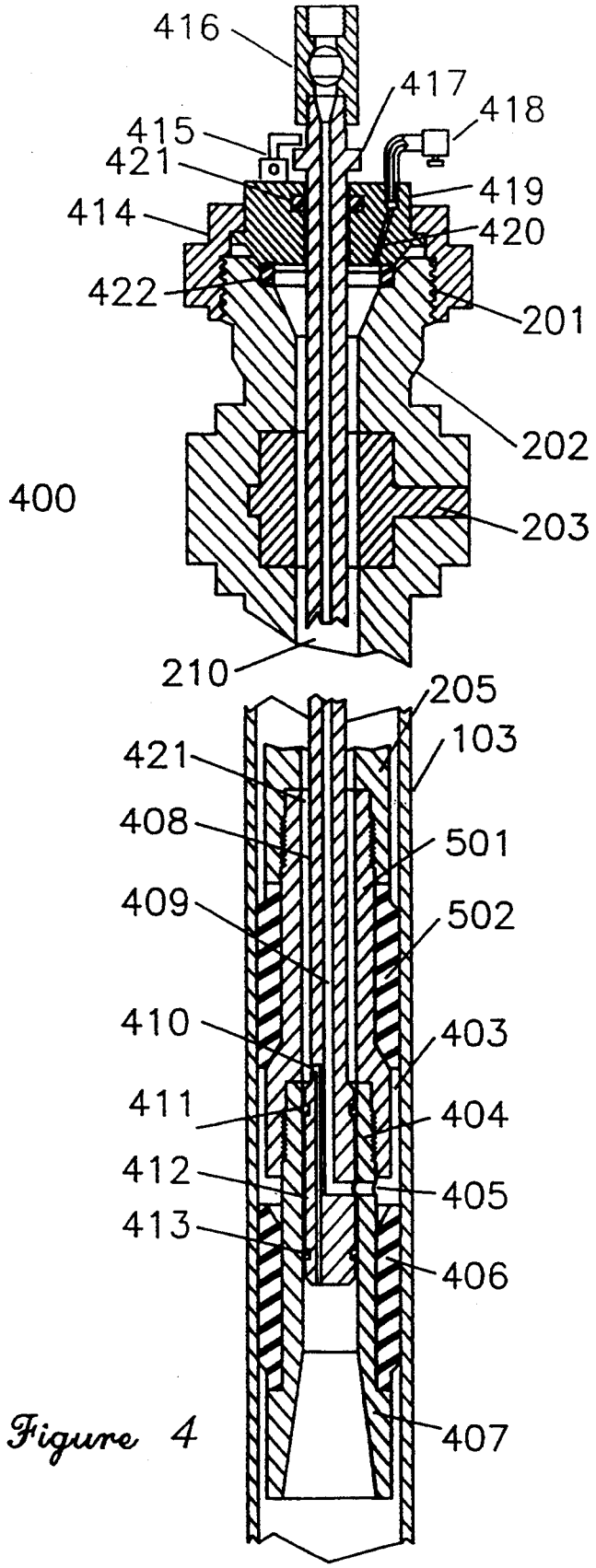
FIG. 4 is a side view cross section of a mechanical arrangement according to the invention which will allow testing of the sealing nipple with the isolation tool mounted as in FIG. 3.

An embodiment of the seal testing system is shown in FIG. 4 where the assembly shown generally at 400 is installed in the isolation tool prior to the isolation tool being installed on the wellhead. The testing system of FIG. 4 is designed particularly for a prior art sealing nipple of the removable seal type such as that described in the Sutherland-Wenger patent mentioned earlier, and as shown in FIG. 5, although this same test apparatus and procedure would also be applicable for a bonded nipple seal. The sealing nipple assembly includes an upper seal body 501 having on its circumference a removable upper seal 502 and diffuser 503, all assembled to the mandrel 205 with the vertical bore 210. The reason for the notation of upper in the seal description is for ease of differentiation in this and the following embodiments. The sealing nipple assembly of FIG. 4 has an upper seal body 501, removable upper seal 502, a lower seal body 404 attached to the upper seal body 501, this lower seal body having a test port 405 extending from the vertical bore 210 in the lower seal body 404 to the test annulus created at 403 by the test seal 406, the removable upper seal 502, the casing 103 and the upper and lower seal bodies 501 and 404. The lower seal body 404 terminates at its lower end in a diffuser section 407. An internal mandrel 408 having internal bore 409 and enlarged lower end 412 is installed in the isolation tool vertical bore 210 creating an internal annulus 421 between the exterior of the internal mandrel 408 and the interior of the isolation tool mandrel 205.

In the position shown in FIG. 4, the internal bore 409 connects to the port 405 and is sealed from the vertical bore 210 above and below by internal mandrel seals 411 and 413. The upper end of the internal mandrel 408 has a shoulder 417 which is restrained by a latch 415 attached to cap 419, the upper end terminating at test valve 416, which is shown in the closed position. Below the shoulder, the internal mandrel 408 is sealed by a packing 423 in the cap 419. The cap 419 also has port 420 and vent valve 418 connecting the annulus 421 formed by the internal mandrel 408 and the isolation tool mandrel vertical bore to the exterior of the assembly. The cap 419 is held to the isolation tool upper connection 201 by ring 414 and will contain any pressure in the internal annulus with seal ring 422. The combination of the seal 406, lower nipple 404 and the lower portion of the enlarged end 412 of the inner mandrel 408 including the seal 413 in FIG. 4 isolates well pressure and fluid above them from well pressure and fluid below them.

To test the removable upper seal 502, test fluid is pumped from an outside source through test valve 416, down the internal bore, through the port 405 and thus into the test annulus 403. This fluid pressure acts in an upward direction on the removable upper seal 502 and in a downward direction on the test seal 406, which in the example shown are mirror image seals, and on the casing 103 adjacent to these seals.

After the selected test pressure has been reached and held for a time determined by the operator, the test fluid is allowed to escape upwards through the test valve 416. Thus the removable upper seal may be tested to ensure that it can withstand the pressure selected by the operator. The test seal is redundant for the well treatment procedure. In order to remove the internal mandrel from the vertical bore of the isolation tool, there are two cases.

Case 1. If there is no pressure in the well casing, the latch 415 is activated to release the internal mandrel shoulder 417 and the internal mandrel 408 is withdrawn upwards until the enlarged lower end 412 is above the valve plug 203. Valve plug 203 is rotated to the closed position, the cap 419 unscrewed from the upper connection 201 and the internal mandrel 408, cap 419 and associated items are removed. The well may now be treated through the isolation tool vertical bore in the usual way.

Case 2. If there is pressure in the well, and this will be known beforehand, the internal annulus 421 is filled with a suitable hydraulic fluid prior to the isolation tool being inserted into the well. When the seal test has been completed and it is required to extract the internal mandrel, the latch 415 is activated to release the internal mandrel 408 and the action of the well pressure on the enlarged end 412 of the internal mandrel will push the internal mandrel up. This upwards movement will be controlled by venting the hydraulic fluid from the internal annulus through the vent valve 418. When the enlarged end 412 of the internal mandrel is above the isolation tool valve plug, the valve plug 203 is closed, containing the well pressure in the vertical bore below it. Pressure in the internal mandrel 408 is vented through the test valve 416 and the internal mandrel, cap and associated items are removed. The well may now be treated through the isolation tool vertical bore in the usual way.

Figure 6:
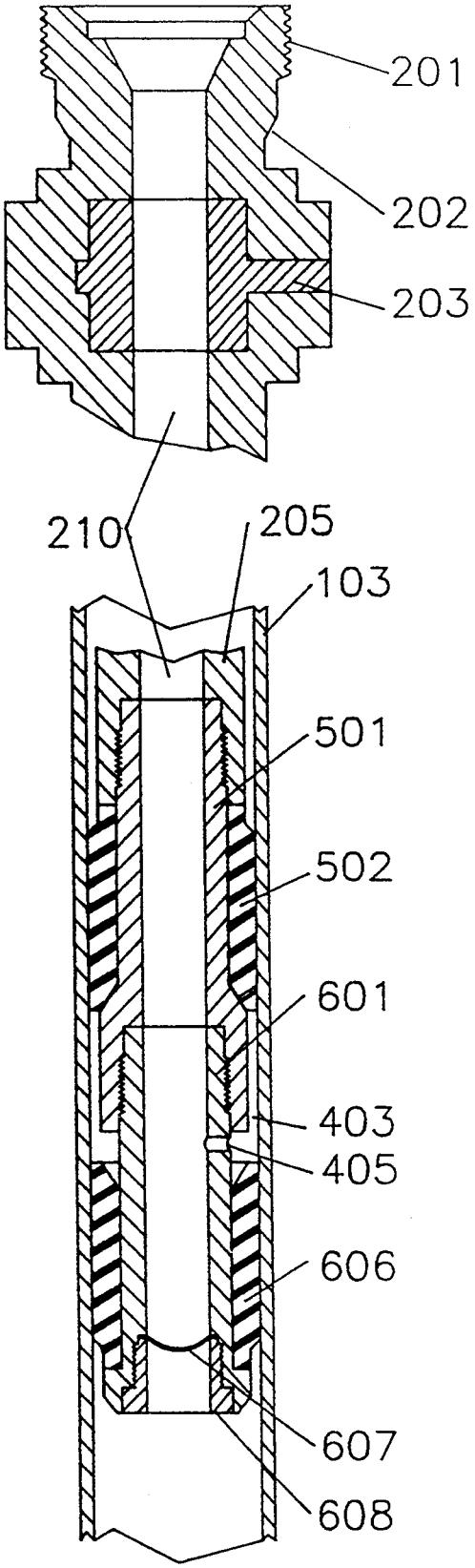
FIG. 6 is a side view cross section of a second mechanical arrangement according to the invention which will allow testing of the sealing nipple with the isolation tool mounted as in FIG. 3.
Figure 7:
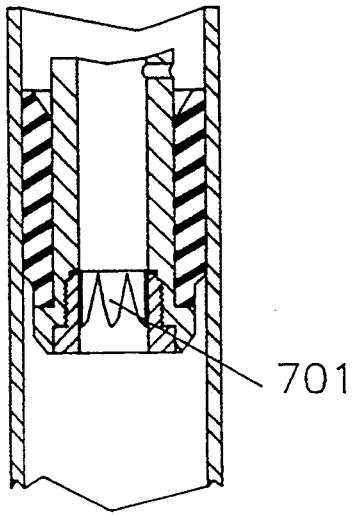
FIG. 7 is a partial side view cross section of the arrangement from FIG. 6 showing a ruptured burst disk.

A further embodiment of the pressure testing system is described in FIG. 6 and FIG. 7. The nipple system shown in FIG. 6 on the lower end of the isolation tool mandrel consists of the upper nipple body 501, the removable upper seal 502, test extension 601 with test port 405, test seal 606 disposed about the test extension 601, burst disk 607 closing off the otherwise open end of the test extension 601 and which isolates the mandrel vertical bore 210 from the well casing, and burst disk retaining ring 608, which is threaded onto the lower end of the test extension 601 to hold the burst disk 608 in place. The combination of the seal 606, lower nipple 601 and burst disk 607 in FIG. 6 seals the well bore.

When the isolation tool mandrel has been installed in the well in the usual way, test fluid from an outside source is pumped down the mandrel vertical bore 210, through the test port and into the annular space formed by the removable upper seal 502, the test seal 606 and the casing 103. The test fluid pressure is raised to that required by the operator and held for a suitable time. When the test is judged to be satisfactory, the pressure in the bore is raised to a value that will rupture the burst disk 607 as shown at 701 in FIG. 7. The mandrel vertical bore is now open to the well casing. The well treatment may now begin. This second embodiment is considered inferior as there are times when the pressure test required will:

a. Be very close to the yield strength of the casing and the extra pressure required to rupture the burst disk will not be tolerated;
b. The test pressure requested will not be compatible with the available range of burst disk ratings; and
c. The rupture tolerance of the burst disk may allow the disk to rupture at too low a pressure, voiding the test, or to not burst at all and possibly cause the test seal to burst, thus giving the operator a false indication. This would lead to serious problems if the well treatment were to begin.

A further embodiment of the pressure testing system is for isolation tools using the type of sealing nipple system known as the tandem nipple system which uses two separate sealing nipples, one being a backup to the other in the case of failure of the first sealing nipple. The method of attaching the seal to the sealing nipple body makes it necessary to describe two testing methods for this tandem nipple system.

Figure 8:
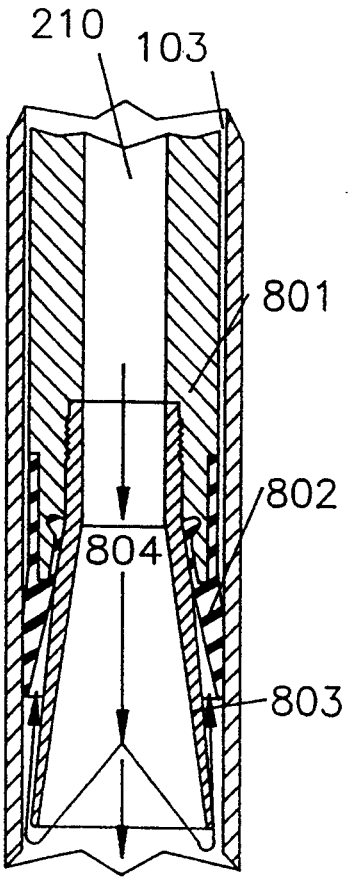
Figure 8 Prior Art
FIG. 8 is a side view cross section of a prior art single seal sealing nipple with a bonded seal.
Figure 9:
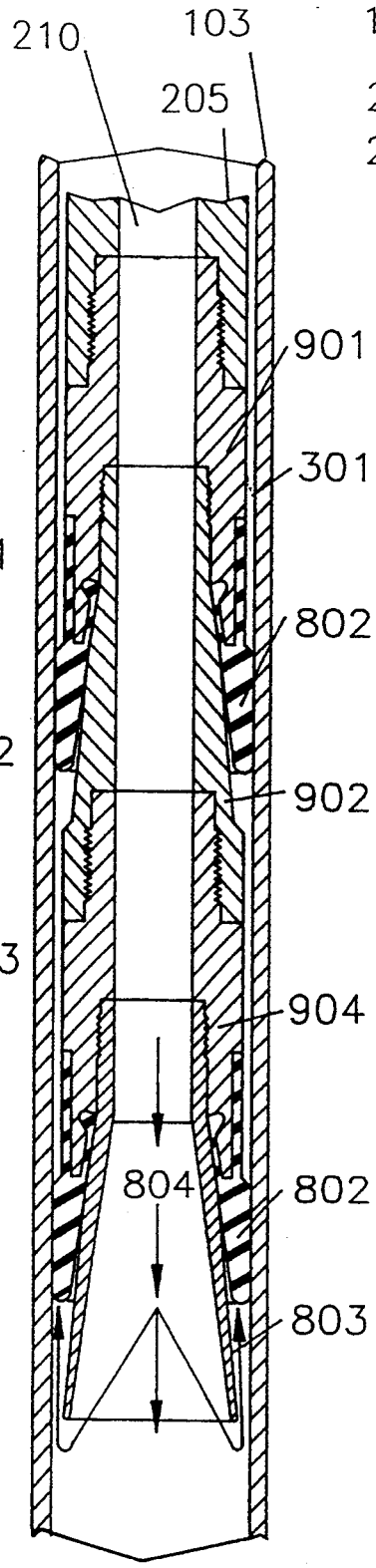
FIG. 9 is a side view cross section of a tandem sealing nipple system with the sealing nipples having bonded seals of the type shown in FIG. 8 in place in the casing.
Figure 10:
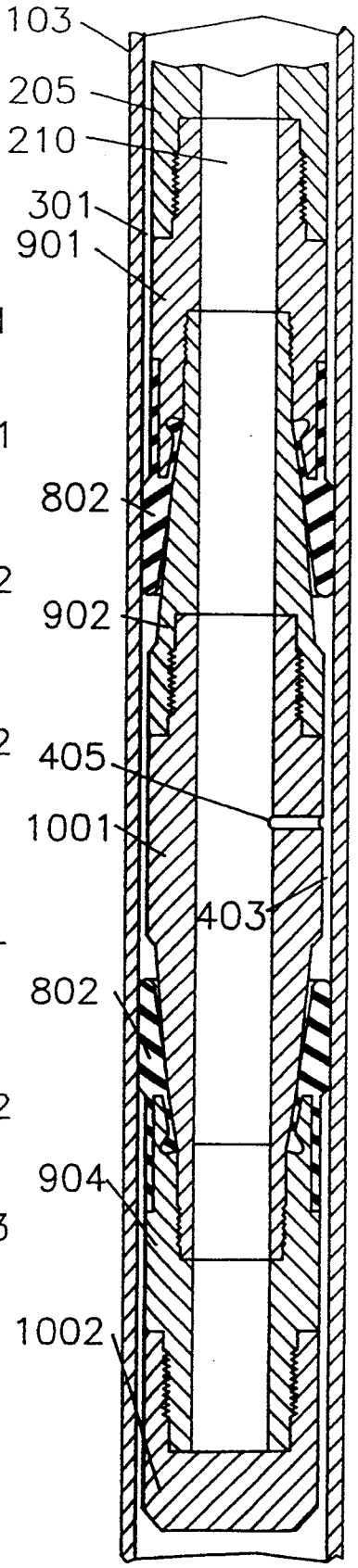
FIG. 10 is a side view cross section of a testing arrangement according to the invention for the tandem sealing nipples of FIG. 9.

Testing a tandem nipple system variant 1: This system utilizes two sealing nipples with the seal bonded to the nipple body as shown in FIG. 8, taken from the aforementioned patent of McLeod. The sealing nipple consists of nipple body 801 and circumferential bonded seal 802 and which is further reinforced by conical insert 803. The action of the well treating fluid pressure is shown as arrows 804. When utilized in the tandem nipple system, the sealing nipple assembly appears as in FIG. 9. Attached to the isolation tool mandrel is an upper nipple body 901 with bonded seal and tandem cone 902. Attached to the tandem cone 902 is a lower nipple body 904 with its bonded nipple seal 802 and the conical insert 803. FIG. 10 shows the arrangement of the upper and lower nipple bodies and bonded seals when arranged for pressure testing. The upper nipple body 901, bonded seal and tandem cone 902 have attached a tandem test body 1001 with test port 405 which has attached at its lower end the reversed lower nipple body 904 and bonded seal 802. Test cap 1002 is fitted to the lower end of the lower nipple body 904. This seals the mandrel vertical bore from the well casing. The upper and lower bonded seals and and tandem cone 902, tandem test body 1001 and the casing 103 form the test annulus 403 which is connected to the vertical bore 210 of the mandrel 205 through the test port 405. The combination of the bonded seal 802, lower nipple body 904 and test cap 1002 in FIG. 10 seals the well bore to allow testing.

Figure 11:
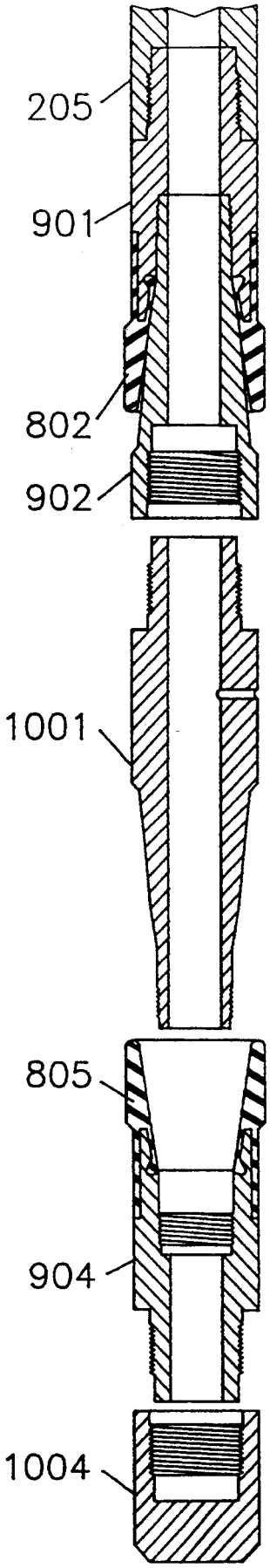
FIG. 11 is an exploded side view cross section of the tested assembly from FIG. 10.
Figure 12:
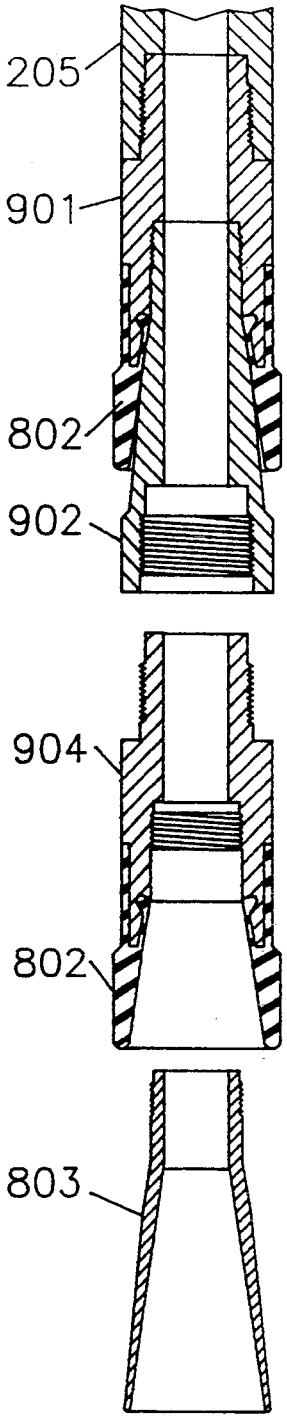
FIG. 12 is a side view cross section showing new positions of the tested items from FIG. 11.
Figure 13:
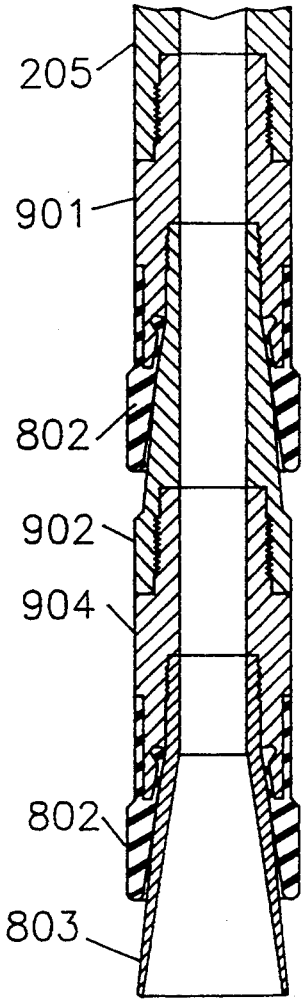
FIG. 13 is a side view cross section showing final assembly of the items from FIG. 12.

To pressure test the bonded upper and lower seals 802, test fluid is pumped from an outside source through the opened valve plug 203 down the mandrel vertical bore and through the port and thus into the test annulus. This fluid pressure acts in an upward direction on the upper nipple bonded seal 802 and in a downward direction on the reversed lower nipple bonded seal, which in the example shown are mirror image seals, and on the casing 103. After the selected test pressure has been reached and held for a time determined by the operator, the test fluid is allowed to bleed back through the valve plug 203. It has now been determined that the bonded seals will seal under the required pressure in the position in the casing where they were tested. It is noted that the length of the tandem test body 1001 positions the seal 802 on the reversed lower nipple 904 in the same position as the lower seal in the original system of FIG. 9. This assures that the tested position of the reversed lower nipple bonded seal in the casing will remain the same when the lower nipple is in the original position as in FIG. 9. The wellhead isolation tool is now removed from the wellhead in the usual way. The test cap, lower nipple 904 and tandem test body 1001 are disassembled from the upper nipple 901 and tandem cone 902 as shown in FIG. 11. The test body and test cap are removed. The lower nipple 904 with bonded seal 802 are reversed as a unit as shown in FIG. 12. The conical insert 803 is also shown. The lower nipple 904 with the bonded seal 802 and conical insert 803 are assembled and attached to the tandem cone as shown in FIG. 13. The isolation tool is again attached to the wellhead and the mandrel with the tandem seal is run into the same position in the casing where it had been tested. The upper and lower bonded seals are now in the position where they were tested and the well treatment may begin.

Figure 14:
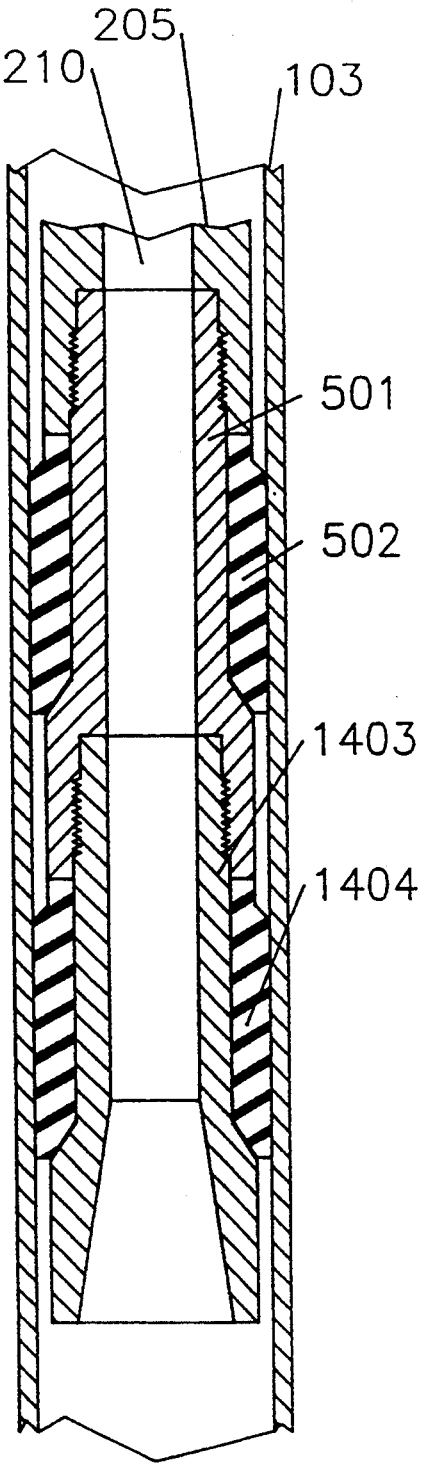
FIG. 14 is a side view cross section illustrating a tandem sealing nipple system in the casing, the sealing nipples having removable seals of the type shown in FIG. 5.
Figure 15:
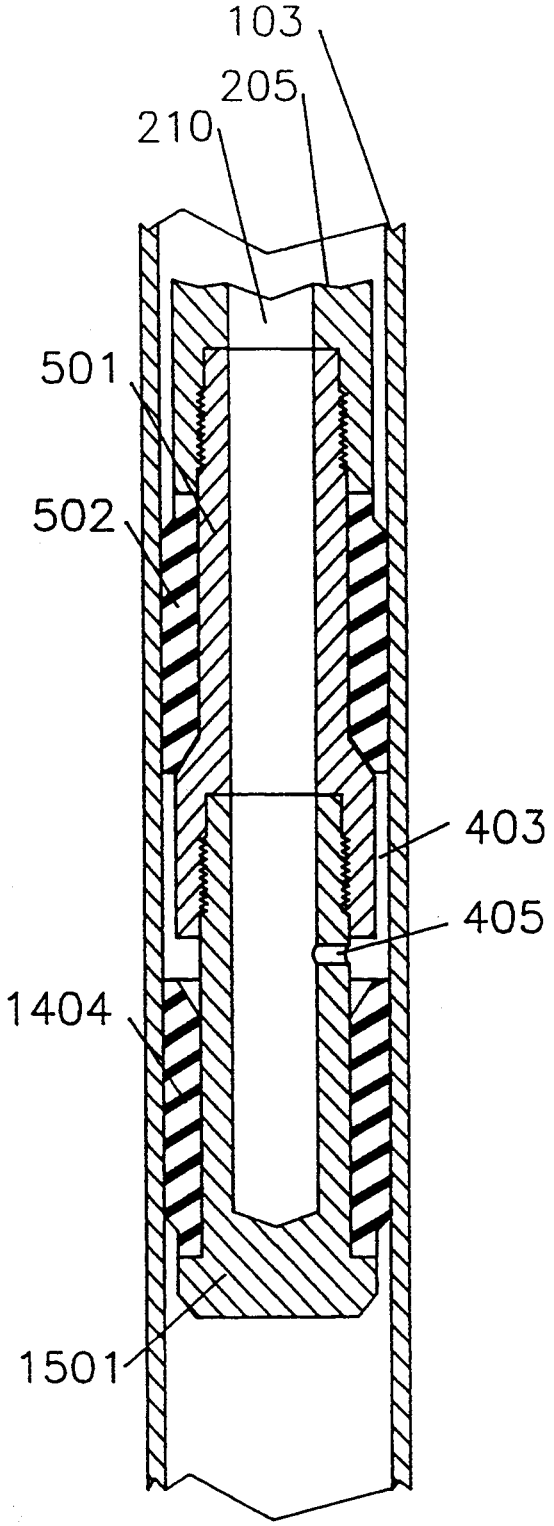
FIG. 15 is a side view cross section of the tandem sealing nipples of FIG. 14 arranged in a position for pressure testing.

Testing a tandem nipple system variant 2: This system utilizes two sealing nipples of the removable seal type as shown in FIG. 5. This consists of an upper nipple body 501 which attaches to the isolation tool mandrel and has a removable upper seal 502 on its circumference, this sealing against the casing 103. The tandem nipple sealing system for the removable seal nipple is shown in FIG. 14. The upper nipple body 501 and upper removable seal 502 are attached to the mandrel 201. To this upper nipple body is attached the tandem body 1403 with the lower removable seal 1404. The upper and lower removable seals 502 and 1404 may be identical in shape. FIG. 15 shows the tandem arrangement ready for testing. The upper nipple body 501 and upper removable seal 502 are attached to the mandrel 201, with tandem seal test body 1501 attached to the lower end of the upper nipple body 501. Test port 405 extends through the test body 1501, which has the reversed lower removable seal 1404 disposed about it. The inside of the mandrel 205 is blocked from the well pressure by the plugged end of the tandem seal test body 1501. The two seals 502 and 1404, upper nipple body 501 and tandem test body 1501 define the test annulus 403 along with the casing. The test annulus is bounded above and below by the upper nipple seal 502 and the lower nipple seal 1404 respectively. Test port 405 communicates between the upper nipple bore (an extension of the mandrel bore 210) and the test annulus. The combination of the seal 1404 and tandem test body 1501 of FIG. 15 seal the well bore to allow testing.

Figure 16:
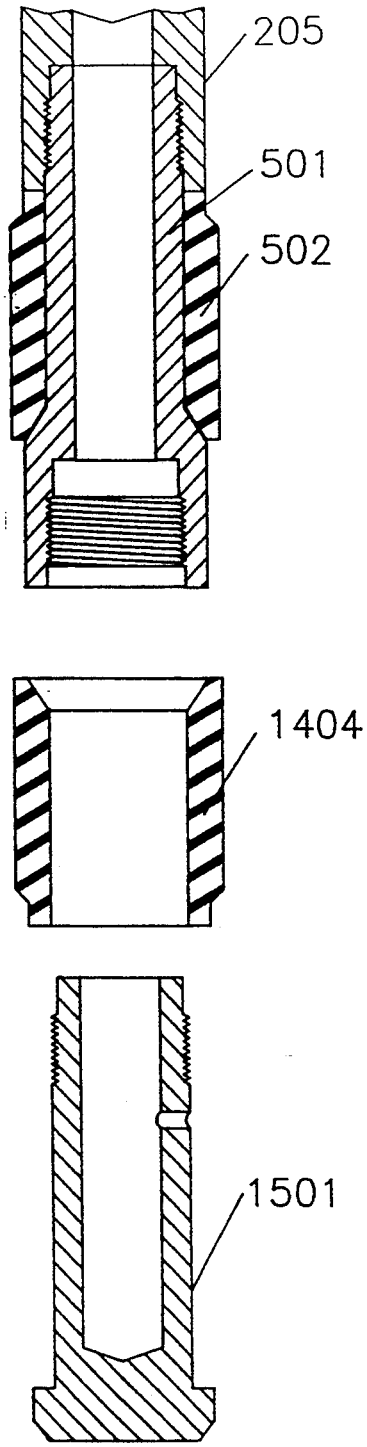
FIG. 16 is an exploded side view cross section of the tested assembly from FIG. 15.
Figure 17:
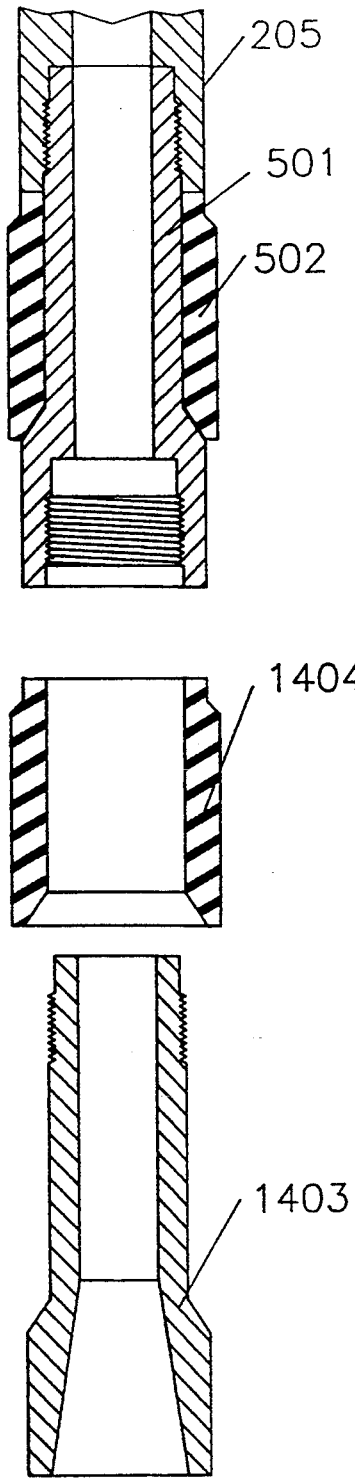
FIG. 17 is a side view cross section of new positions of the tested sealing nipples from FIG. 16.
Figure 18:
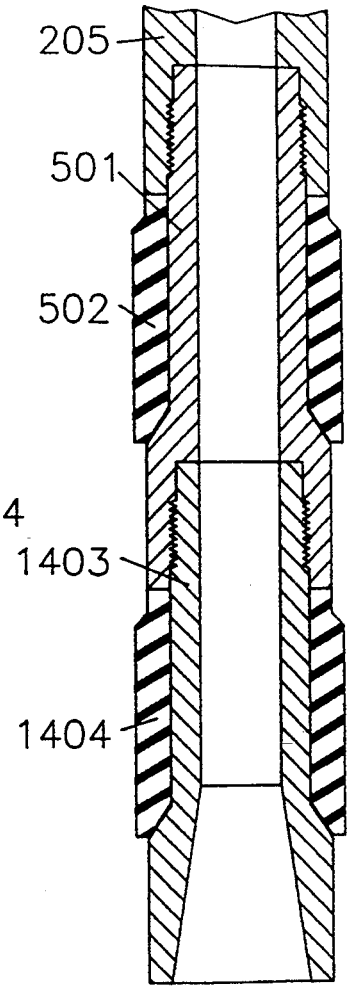
FIG. 18 is a side view cross section showing the final assembly of the tested nipple seals from FIG. 17.

With the isolation tool in place on the wellhead, fluid is pumped down the isolation tool mandrel vertical bore 210, through the test port 405 and into the test annulus 403. This fluid pressure acts on the upper removable seal 502 and the lower removable seal 1404 and on the casing adjacent to these seals. After the selected test pressure has been reached and held for a time determined by the operator, the test fluid is allowed to bleed back through the valve plug. It has now been determined that the seals will seal under the required pressure in the position in the casing where they were tested. It is noted that the length of the tandem test body 1501 positions the reversed lower removable seal 1404 in the same position as the lower removable seal in the original system of FIG. 14. This assures that the tested position of the reversed lower removable seal in the casing will be the same when the lower nipple body is in the original position shown in FIG. 14. The wellhead isolation tool is now removed from the wellhead in the usual way and the tandem nipple system is disassembled with the removal of the tandem testing body and reversed removable lower seal as in FIG. 16. The tandem test body is removed. The reversed lower removable seal is rotated as shown in FIG. 17 and the lower nipple body is added. The lower removable seal and the lower nipple body are then attached to the upper nipple body as shown in FIG. 18. The isolation tool is again attached to the wellhead and the mandrel with the tandem seal is run into the same position in the casing where it had been tested. The upper and lower removable seals are now in the position where they were tested and the well treatment may begin.

As used in the claims, the sealing means includes the seal 406, lower nipple 404 and the lower portion of the enlarged end 412 of the inner mandrel 408 including the seal 413 in FIG. 4; the seal 606, lower nipple 601 and burst disk 607 in FIG. 6; the bonded seal 802, lower nipple body 904 and test cap 1002 in FIG. 10; and the seal 1404 and tandem test body 1501 of FIG. 15. Also, the means for connecting the sealing means to the nipple includes the upper threaded portions of each of the lower nipple bodies 404 and 601, the upper threaded portion of the tandem test body 1501 and the upper threaded portion of the nipple body 904 as shown in FIG. 9 (lower threaded portion of the same nipple body 904 as shown in FIG. 10). It will be further understood by a person skilled in the art that for the testing device to work, the lower part of the upper nipple seal 502, 802 must be open to well pressures exerted through the test valve 418 and this will be assumed to be the case in the claims. This is the normal case in a wellhead isolation tool, so that in effect what is meant by this is that the attachment of the sealing means should not isolate the upper nipple seal from well pressures, for otherwise the testing could not be accomplished. There are several ways of accomplishing this, though when a lower nipple or tandem nipple is used this is preferably accomplished using a port such as the test port 405 or like means in the lower or tandem nipples.

Further Alternative Embodiments

A person skilled in the art could make immaterial modifications to the invention described and claimed in this patent without departing from the essence of the invention.

The embodiments of the invention in which an exclusive property or privilege is claimed are defined as follows:

1. In a wellhead isolation tool for use on a wellhead having casing, the wellhead isolation tool including a mandrel having a first nipple, the first nipple having a nipple bore, and a first nipple seal for isolating the wellhead from fracturing pressure, the improvement comprising:

sealing means disposed in sealing engagement with the casing below the first nipple seal for isolating well pressure and fluid above the sealing means from well pressure and fluid below the sealing means; and means for connecting the sealing means to the nipple.

2. In the wellhead isolation tool of claim 1, the improvement further comprising the sealing means including a second, lower nipple and a second seal disposed about the lower nipple to seal the lower nipple to the casing.

3. In the wellhead isolation tool of claim 2 the improvement further comprising the first and second seals being mirror images of each other, and the lower nipple having means to connect the lower nipple to the upper nipple at each end of the lower nipple.

4. In a wellhead isolation tool for use in a well having casing, the casing defining a well bore, the wellhead isolation tool having an upper nipple, the upper nipple having a nipple bore, and an upper nipple seal for isolating the wellhead from fracturing pressure, the improvement comprising:

sealing means connected to the upper nipple for movement with the upper nipple during installation and removal of the wellhead isolation tool, the sealing means including a lower nipple having a lower nipple seal disposed circumferentially around the lower nipple for contacting the well casing and for sealing the well bore.

5. In the wellhead isolation tool of claim 4, the improvement further comprising the lower nipple being closed to prevent fluid from bypassing the lower nipple seal.

6. In the wellhead isolation tool of claim 4, the improvement further comprising the lower nipple having a bore, the bore being closed by a burst seal.

7. In the wellhead isolation tool of claim 4, the improvement further comprising:

the lower nipple having a bore, and the sealing means further including a mandrel extending into the wellhead isolation tool and having a sealing end for sealing against the lower nipple to seal the bore of the lower nipple.

8. In the wellhead isolation tool of claim 4, the improvement further comprising:

the lower nipple being threaded onto the upper nipple, the lower nipple and casing forming an annulus bounded above and below by the upper nipple seal and the lower nipple seal respectively and including a test port communicating between the upper nipple bore and the annulus.

9. In the wellhead isolation tool of claim 4, the improvement further including:

a tandem nipple, the lower nipple being connected to the upper nipple by the tandem nipple, the upper nipple, tandem nipple and lower nipple and casing forming an annulus bounded above and below by the upper nipple seal and the lower nipple seal respectively and including a test port in the tandem nipple communicating between the upper nipple bore and the annulus.

10. A method of testing a seal for a wellhead isolation tool, the tool including a mandrel and first sealing nipple having at least a first seal, while the wellhead isolation tool is attached to a wellhead having a well bore, comprising the steps of:

attaching the isolation tool to the wellhead;

inserting the mandrel and first sealing nipple into the well bore, the first sealing nipple carrying the first seal;

sealing the well bore below the first seal; and applying test pressure into the well bore.

11. The method of claim 10 in which the well bore is sealed by a second seal in conjunction with a second sealing nipple, the second sealing nipple being attached to the first sealing nipple and sealing the well bore is accomplished by inserting the first sealing nipple into the well bore with the first and second seals sealed by a friction fit with the well casing.

12. The method of claim 11 in which the second seal and first seal are mirror images of each other and further comprising, after testing the first seal with well pressure, removing the first and second sealing nipples, reversing the second sealing nipple and replacing the first and second sealing nipples in the well.

* * * * *